US008413858B2

(12) United States Patent
Rasmussen et al.

(10) Patent No.: US 8,413,858 B2
(45) Date of Patent: Apr. 9, 2013

(54) POURING INSERT

(75) Inventors: Lone Ogård Rasmussen, Ringsted (DK); Henrik Casper, Hillerød (DK)

(73) Assignee: Ideas Denmark A/S, Brondby (DK)

( * ) Notice: Subject to any disclaimer, the term of this patent is extended or adjusted under 35 U.S.C. 154(b) by 724 days.

(21) Appl. No.: 12/575,252

(22) Filed: Oct. 7, 2009

(65) Prior Publication Data

US 2010/0091605 A1 Apr. 15, 2010

(30) Foreign Application Priority Data

Oct. 13, 2008 (EP) ..... 08166486

(51) Int. Cl.
*B65D 25/40* (2006.01)
*B65D 47/06* (2006.01)

(52) U.S. Cl. ..... 222/565; 222/575; 222/564; 366/340

(58) Field of Classification Search ..... 222/478, 222/565, 566, 567, 570, 575, 564; 366/336, 366/340

See application file for complete search history.

(56) References Cited

U.S. PATENT DOCUMENTS

| | | | | | |
|---|---|---|---|---|---|
| 2,642,207 | A * | 6/1953 | Renzi | 222/567 |
| 3,198,393 | A * | 8/1965 | Kitterman | 222/570 |
| 3,321,113 | A * | 5/1967 | Conry | 222/477 |
| 3,323,693 | A * | 6/1967 | Miller | 222/564 |
| 4,298,145 | A * | 11/1981 | Iida | 222/571 |
| 4,407,435 | A * | 10/1983 | Harmon | 222/481 |
| 5,799,836 | A * | 9/1998 | Lee | 222/567 |
| 6,568,660 | B1 | 5/2003 | Flanbaum | 261/76 |
| 7,527,180 | B2 * | 5/2009 | Allen et al. | 222/566 |
| D643,721 | S * | 8/2011 | Blinn | D9/440 |
| 8,205,541 | B2 * | 6/2012 | Barberio et al. | 222/566 |
| 2003/0198406 | A1 | 10/2003 | Bibbo et al. | 215/306 |
| 2005/0184026 | A1 | 8/2005 | Haley | 383/41 |

FOREIGN PATENT DOCUMENTS

| | | |
|---|---|---|
| DE | 12 93 051 | 4/1969 |
| DE | 201 19 154 | 2/2002 |
| EP | 0 245 664 | 11/1987 |
| WO | WO 00/56620 | 9/2000 |
| WO | WO 2006/007638 | 1/2006 |

OTHER PUBLICATIONS

European Search Report, EP 08 16 6486, mailed Apr. 8, 2009, 7 pages.

* cited by examiner

*Primary Examiner* — Tony G Soohoo
(74) *Attorney, Agent, or Firm* — Winston & Strawn LLP

(57) ABSTRACT

A pouring insert is provided for insertion into a container outlet, for example a bottleneck, for aerating liquids pored from the container. This is achieved by a combination of a hollow, tapering jacket with a hollow pipe axially disposed within it. The jacket features a plurality of elongated slots penetrating the jacket and allowing for liquid/air flow therethrough. The invention furthermore relates to a bottle pourer having a spout and the pouring insert described herein. The invention also relates to the use of the pouring insert and of the bottle pourer for aerating wine. Finally, the present invention relates to a method of manufacturing the pouring insert by injection molding.

17 Claims, 4 Drawing Sheets

POURING INSERT

TECHNICAL FIELD

Figure 1:
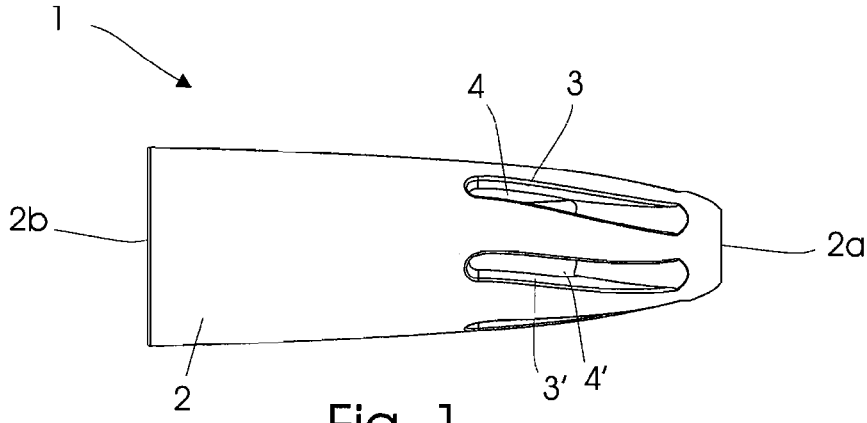

The present invention relates to a pouring insert for insertion into a container outlet, for example a bottleneck, for aerating liquids pored from the container. The invention furthermore relates to a bottle pourer with a spout, the bottle pourer comprising the pouring insert of the present invention. The invention also relates to a use of the pouring insert and of the bottle pourer for aerating wine. Finally, the present invention relates to a method of manufacturing the pouring insert by injection moulding.

When drinking wine, it is often desirable to expose the wine to ambient air prior to consumption. This is known as aeration or breathing of the wine. Wine that has been aerated typically obtains a better aroma and softer flavour. This is especially true for younger red wines with high tannin levels. Tannins are plant polyphenols occurring in the skin and seeds of grapes, and often conveying a bitter, undesired taste.

The simplest known approach for aeration of wine is to uncork the wine bottle and let it rest at ambient conditions for a certain amount of time, say half an hour, prior to consumption. This, however, often results in poor aeration due to the inherent rate limitation of air diffusion into stagnant liquid. Furthermore, the air-liquid-interface is typically located within the bottleneck leaving only a comparatively small surface area for diffusion. Compared to the dimension of the surface area, the liquid body is large and deep limiting also diffusion and mixing within the wine. In addition, this technique may entail undesired changes in wine temperature as well as unwelcome waiting time.

Another known technique contributing to wine aeration is decantation. This involves careful transfer of the wine from its bottle into a receptacle such as a carafe. Apart from the aesthetic effect it is an additional aspect of decantation to separate the wine from sediments such as bitartrate precipitates. A drawback of this approach is the obvious need of an additional container.

Many known wine pourers achieve a limited degree of aeration simply by way of a wide spout. Again, this type of arrangement does little for maximising the interface between wine and air.

International Patent Application WO 2006/007638 discloses a wine pourer device with a closure device for a bottleneck, the device comprising an aerator. The aerator consists of a circular disk with a series of apertures therethrough and a downwardly directed central spigot, which is fitted with a tube. This arrangement enables air/liquid flow through the central tube as well as through the apertures in the disk. However, the air-liquid interface is only slightly increased compared to the above approaches since the apertures simply split the liquid flow into a number of smaller flows, but do not introduce any additional means for achieving turbulence and mixing.

More advanced systems provide for active aeration of bottled wine by means of an electric compressor and a delivery device, for example a tube, that can be inserted into the bottle for actively pumping air into the liquid body. An example of this is given in European Patent Application EP 0245664. The obvious disadvantages of this technique are energy consumption, increased expense and space requirements.

Accordingly, there is a need for a pouring insert that does not possess the disadvantages of known devices. This is now provided by the present invention.

SUMMARY OF THE INVENTION

Thus, it is a first aspect of the present invention to provide a pouring insert which maximizes the liquid-air interface while pouring liquid from a bottle.

It is a second aspect of the present invention to provide a pouring insert which is simple, cost-effective, and may be used with a variety of different container outlets.

It is a third aspect of the present invention to provide a pouring insert which is combinable with a variety of different spouts or other discharging means.

It is a fourth aspect of the present invention to provide a pouring insert which contributes to a significant improvement of the aroma of wine poured through the insert.

The new and unique way in which the present invention fulfils one or more of the above-mentioned aspects is to provide a pouring insert for insertion into a liquid container outlet, the pouring insert comprising a hollow jacket with a distal jacket end and a proximal jacket end, the jacket tapering towards its distal jacket end, a hollow pipe axially disposed within the jacket and having a distal pipe end and a proximal pipe end, the distal pipe end defining a first opening, wherein the jacket comprises a plurality of elongated slots penetrating the jacket, the slots defining a plurality of second openings.

The invention also relates to a bottle pourer that includes a spout and one of the pouring inserts described herein.

Another embodiment of the present invention is a method for aerating wine which comprises pouring wine through one of the pouring inserts described herein. This method may further comprise providing the wine in a container having a liquid outlet; inserting the pouring insert into the liquid outlet, and tilting the container to effect outflow of liquid through the outlet and through the pouring insert. Preferably, the method further comprises providing the pouring insert with one or more openings through which the wine passes and providing one or more of the openings with means for filtering solid particles so as to remove such particles from the wine when pouring the wine from the container.

Finally, the invention also relates to a method of manufacturing one of the pouring inserts described herein by injection moulding the insert from food grade plastic material.

BRIEF DESCRIPTION OF THE DRAWING FIGURES

Figure 2:
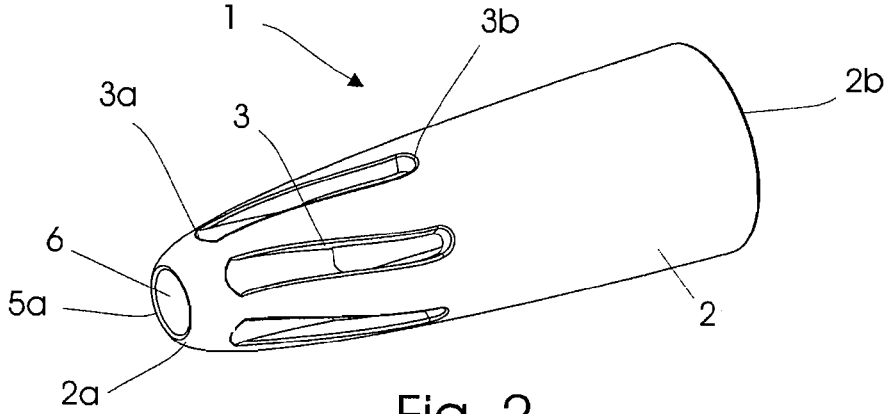
Figure 3:
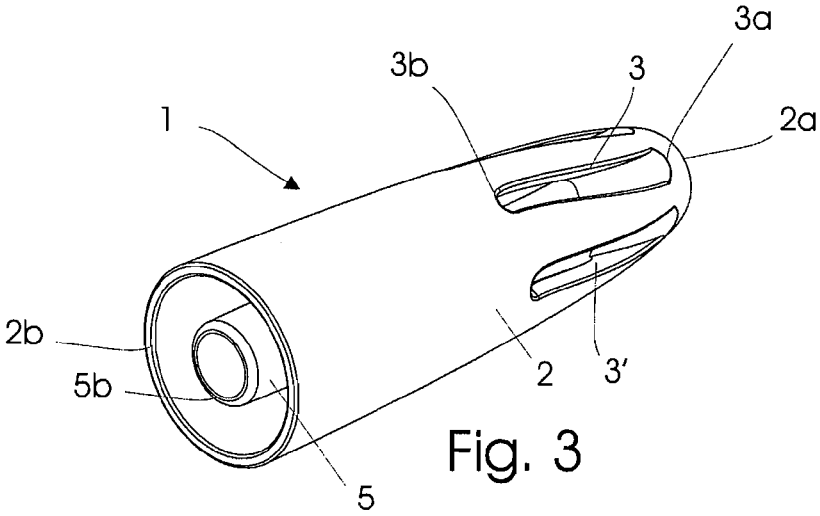
Figure 4:
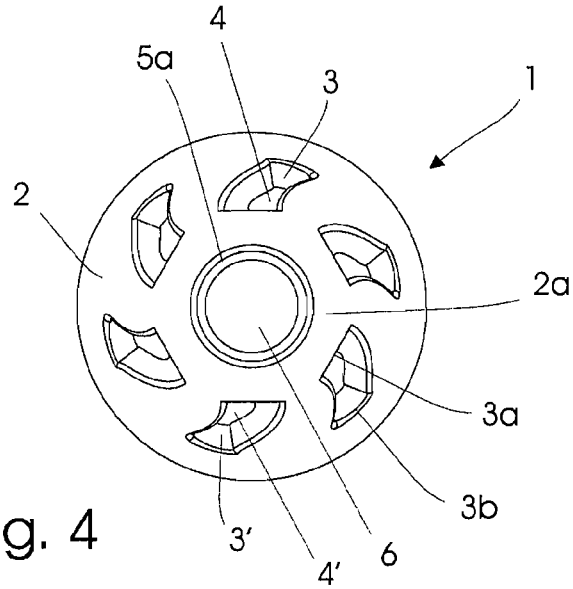
Figure 5:
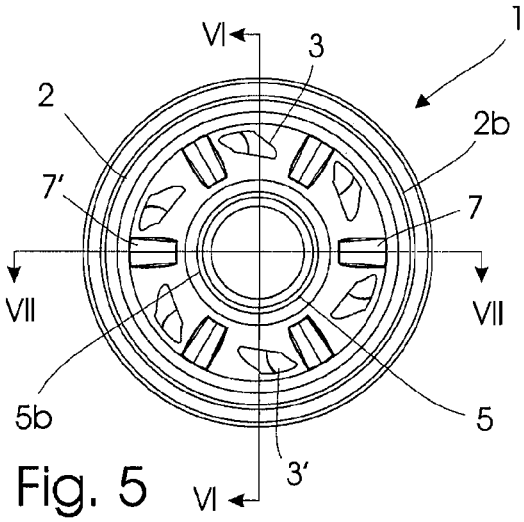
Figure 6:
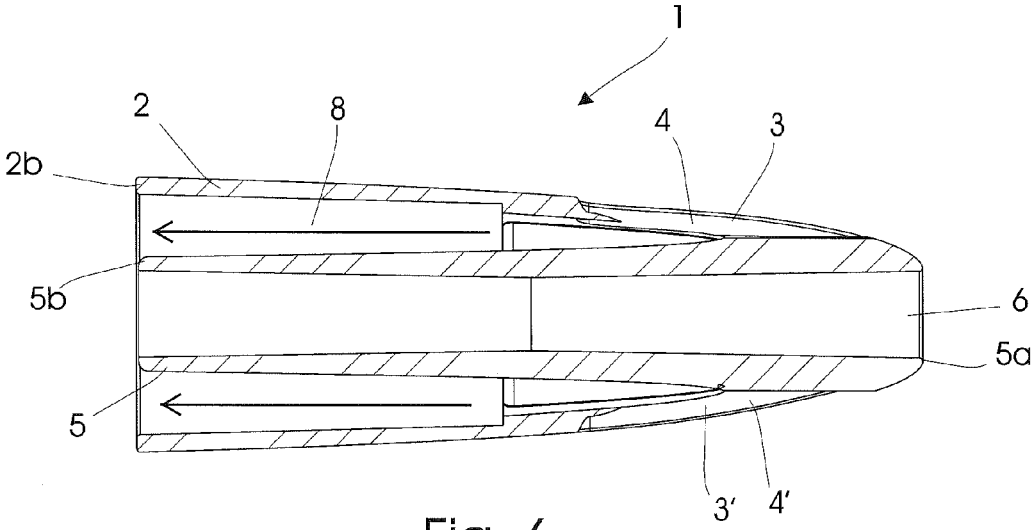
Figure 7:
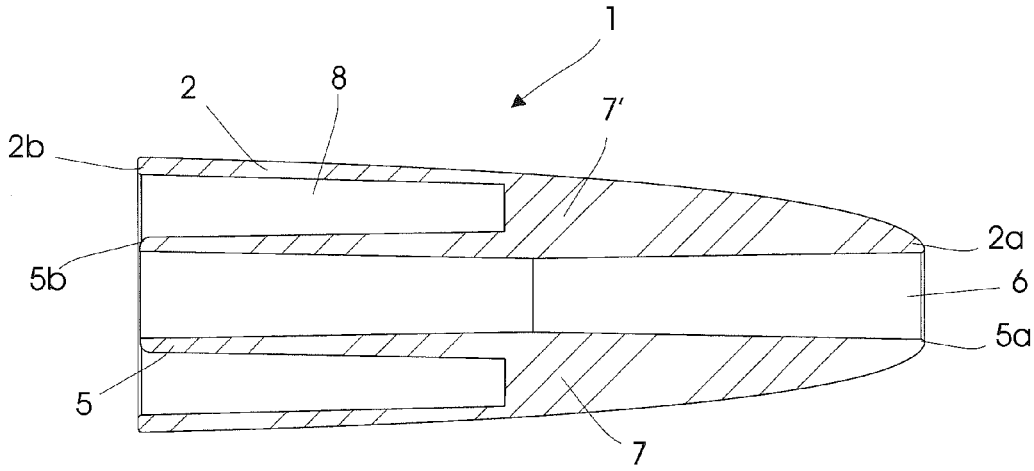
Figure 8:
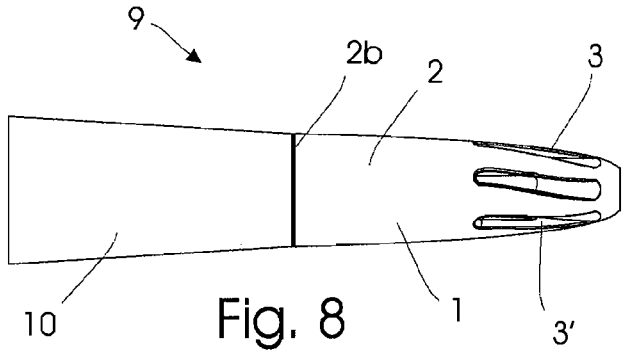
Figure 9:
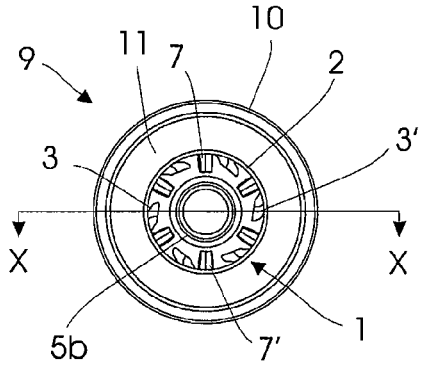
Figure 10:
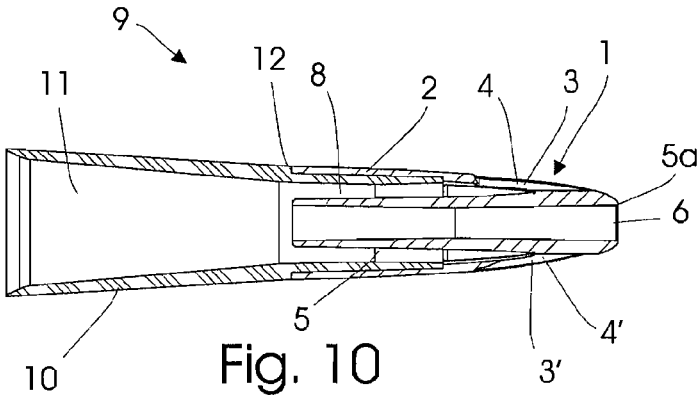

The invention will be explained in greater detail below where further advantageous properties and example embodiments are described with reference to the drawing, in which:

FIG. 1 shows a pouring insert according to the present invention in a side elevational view, FIG. 2 shows a first perspective view of the pouring insert, FIG. 3 shows a second perspective view of the pouring insert, FIG. 4 shows a front view, that is the distal end, of the pouring insert, FIG. 5 shows a rear view, that is the proximal end, of the pouring insert, FIG. 6 shows a first longitudinal cut of the pouring insert taken along the line VI in FIG. 5, FIG. 7 shows a second longitudinal cut of the pouring insert taken along the line VII in FIG. 5, FIG. 8 shows a side elevational view of a bottle pourer according to the present invention, FIG. 9 shows a rear view of the bottle pourer, and FIG. 10 shows a longitudinal cut of the bottle pourer taken along the line X in FIG. 9.

DETAILED DESCRIPTION OF THE PREFERRED EMBODIMENTS

The terms "distal" and "proximal" as used herein refer to the location of elements relative to the user, who inserts the pouring insert into a liquid container outlet, for example a bottleneck of a wine bottle. The distal jacket end will therefore be located closer to the bottle's base whereas the proximal jacket end will be located further up the bottleneck and more distant from the bottle's base. The jacket may be pipe-shaped, which should be understood as comprising a cylindrical shape as well as pipe-shapes that have a quadrangular, oval or any otherwise shaped cross section.

The pouring insert may be inserted into a bottleneck with the distal ends of the jacket and the pipe entering the bottleneck first. When inserted, the longitudinal axis of the pouring insert will usually be aligned with the longitudinal axis of the bottleneck.

The jacket advantageously tapers towards its distal jacket end, thereby ensuring that the insert will fit several sizes of bottlenecks. The jacket may have a circular cross section along its entire longitudinal extent. As an example the outside diameter of the cross section at the proximal jacket end may be around 18-20 mm, while the outside diameter of the cross section at the distal jacket end, i.e. its tapered end, may be around 5-8 mm.

Typically, the hollow pipe axially disposed within the jacket will be placed centrally within the jacket, so that the jacket receives the pipe in a co-axial arrangement. However, other arrangements are conceivable, for example the longitudinal axis of the pipe being offset from the longitudinal axis of the jacket.

The pipe is preferably a cylinder with two open ends where the distal pipe end, that is the end that is closer to the base of the bottle when inserted into a bottle, defines a first opening. Through this opening liquid may flow from inside of the bottle to the outside.

The jacket comprises a plurality of elongated slots penetrating the jacket. The slots allow for movement of air into, and movement of liquid out of, the bottle. The slots define a plurality of second openings, which, owing to the combination of the tapered design of the jacket and the longitudinal extent of the slots, considerably increase the contact surface, or interface, between liquid and air while pouring liquid. This is especially true when, during pouring, both liquid and air are present in one or more slots. Also, the slots may define narrow flow channels, thus increasing turbulence and mixing of water and air.

Preferably, the slots are formed close to the distal jacket end. Advantageously, the slots' longitudinal extent is longer than the respective transverse extension.

According to an expedient embodiment of the present invention, at least one of the elongated slots has a sinuous shape. Preferably, all the slots have a sinuous shape. This shape contributes to an even better mixing between liquid and air due to the creation of a swirling, sinusoidal and/or helical flow path. By this arrangement, a full, 360 degrees rotational movement and aeration may be achieved. This may apply both to liquid leaving the bottle through the sinuous-shaped slots as well as to air entering the bottle through the sinuous-shaped slots.

In another embodiment of the present invention, at least one of the elongated slots has a longitudinal alignment that is axial with respect to the jacket. Thereby, the slots are substantially parallel to the longitudinal axis of the jacket, subject to possible sinuosity of the slots. This has the effect that both air and liquid are expediently guided into a sinuous, curved flow path.

In a preferred embodiment of the pouring insert, the jacket has the same longitudinal extent as the hollow pipe. By this it is achieved that the first opening as defined by the distal pipe end is at least as close to the base of the bottle as the second openings, i.e. the longitudinal slots. Usually, the slots will be placed at a distance higher up the bottleneck, i.e. further away from the base of the bottle, as compared to the first opening.

The proximal end of the insert of the present invention will typically comprise a circular edge placed centrically within another, larger circular edge, provided both the jacket and the pipe have a circular cross section.

In another embodiment of the present invention, the longitudinal extent of the slots is between 30 and 60% of the longitudinal extent of the jacket. By making the slots comparatively long, say 50% of the length of the jacket, advantageous flow guidance is achieved, especially when using sinusoidal slots.

In another embodiment of the present invention, each of the elongated slots comprises a first and a second end, where the first end is closer to the distal jacket end than the second end, and where the first end is angularly displaced relative to the second end with respect to the cross section of the jacket. This arrangement will contribute to a circular flow as created by the slot since the liquid or the air is forced to be angularly displaced when flowing through the slots.

In another embodiment of the present invention, the hollow pipe is disposed coaxially within the jacket, and the elongated slots are arranged concentrically around the hollow pipe. Such an arrangement ensures an expedient utilisation of available flow cross section, and also contributes to a well-regulated flow-pattern.

In another embodiment of the present invention, the distal pipe end is merged with the distal jacket end. In this embodiment, the jacket tapers to such an extent that its outer diameter coincides with the outer diameter of the hollow pipe at both elements' respective distal ends. This results in a torpedo-shaped design, which is space-efficient and contributes to a well-regulated flow-pattern.

In another embodiment of the present invention, the hollow pipe is fixed to the jacket by means of one or more ribs extending axially between the pipe and the jacket along at least part of the longitudinal extent of the pipe and the jacket. The ribs may thus compartmentalise part of the inner volume of the jacket. The ribs may furthermore separate one or more flow paths through the slots for at least part of the longitudinal extent of the jacket. The ribs may be made of the same material as the jacket and the pipe. Optionally, the jacket, the ribs and the pipe may be manufactured as one piece, for example by injection-moulding, from a plastic or polymer material of the type that is suitable for handling food or beverage products.

In another embodiment of the present invention, the jacket is conically or frustoconically shaped. This contributes to a flexible, space-efficient design, which furthermore results in a beneficial flow regime. Also, this design contributes to a pouring insert which may fit bottlenecks of various sizes.

In yet another embodiment of the present invention, one or more of the openings comprise filtering means for filtering solid particles from a liquid. This may be of particular relevance when pouring wine with a high level of precipitates. The filtering means may include any type of sieve, membrane or the like.

In another embodiment of the present invention, the insert is preferably made of one or more polymers such as silicone. Other polymers are conceivable. Most importantly, the choice of polymers should be suitable for the liquid at hand, and for contact with foodstuffs in general, implying that it should be non-toxic. Advantageously, the polymer is elastic.

The insert of the present invention is of particular use when combined with one or more elements of known bottle pourers, for example with a spout. Thus, in another embodiment of the present invention, there is provided a bottle pourer with a spout, the bottle pourer comprising a pouring insert according to the present invention. A spout may be attached to the proximal jacket end. The spout may have any shape, for example funnel-shaped, and may be made of various materials. Additional features may be provided for such a bottle pourer, for example a lid, or other appropriate sealing means. The spout may be received in the jacket in a core-sheath arrangement where the spout is releasably plugged into the proximal jacket end. Other releasable or permanent fastening means for attaching the spout to the jacket are conceivable. These include clips, adhesives, fastening braces, rings or similar arrangements.

The present invention further relates to the use of the bottle pourer for aerating wine.

The present invention also relates to the use of the pouring insert according to the present invention for aerating liquid when pouring it from a container, the use comprising insertion of the pouring insert into the outlet of a liquid container, and tilting the container to effect outflow of liquid through the outlet and through one or more of the openings of the pouring insert placed within the outlet.

The present invention also relates to a method of manufacturing the pouring insert of the present invention by injection moulding. This is especially advantageous, but not limited to, embodiments where the jacket, the ribs and the pipe are provided as one piece.

Although the term "container" as used herein is often equated with a bottle, it goes without saying that any other container and its respective outlet may be used in connection with the pouring insert of the present invention. This includes cups, cans, packs, or canisters, provided they have a suitable outlet. Having said that, the container that will be typically used with the pouring insert of the present invention is a wine bottle.

Similarly, while the present application repeatedly refers to wine as a liquid that may be poured in connection with the pouring insert of the present invention, it should be noted that the pouring and aeration of any other liquid, such as water, soft drinks or tea, may be improved by using the insert of the present invention.

Turning now to the drawings, in the embodiment shown in FIG. 1, the pouring insert 1 comprises a generally frustoconically-shaped, tapering jacket 2 with a proximal jacket end 2*b* and a distal jacket end 2*a*. The pouring insert 1 may be inserted into a bottleneck (not shown) with the distal jacket end 2*a* entering the bottleneck first. The pouring insert 1 of FIG. 1 also comprises a plurality of elongated slots 3, 3' penetrating the jacket 2. For the sake of illustration only two of the slots are given reference numerals. Each slot 3, 3' has a sinuous shape and a longitudinal alignment that is axial with respect to the jacket 2. The slots define a plurality of openings 4, 4' through which liquid and/or air may travel during pouring. The slots 3, 3' have a longitudinal extent that is about one third of the longitudinal extent of the jacket 2.

FIGS. 2 and 3 show perspective views of the insert 1 from an angle close to the distal jacket end 2*a* and close to the proximal jacket end 2*b*, respectively. As in all figures, the same reference numerals denote the same or corresponding parts. Within the jacket 2 is axially disposed a hollow pipe 5 having a distal pipe end 5*a* and a proximal pipe end 5*b*. The distal pipe end 5*a* of the pipe 5 defines an opening 6 through which liquid and/or air may travel during pouring. The hollow pipe 5 is disposed coaxially, i.e. centrally, within the jacket 2.

As best seen in FIG. 3, each slot 3, 3' comprises a first end 3*a* and a second end 3*b*, where the first end 3*a* is closer to the distal jacket end 2*a* than the second end 3*b*. The first end 3*a* is angularly displaced relative to the second end 3*b* with respect to the cross section of the jacket 2. This can also be seen in FIG. 4, which shows a front view, i.e. a plan view of the distal end 2*a* of the jacket 2.

FIG. 5 shows a rear view of the pouring insert 1, i.e. a plan view of the proximal jacket end 2*b*. This view generally corresponds to the view one would get when looking down a bottleneck into which the insert 1 is placed. The concentric arrangement of the pipe 5 and the jacket 2 is easily seen. Furthermore, this view reveals a possible way of attaching the jacket 2 to the pipe 5, which is here achieved by a number of ribs 7, 7' extending axially between the pipe 5 and the jacket 2 along part of the longitudinal extent of the pipe 5 and the jacket 2. In total, the insert 1 of FIG. 5 comprises six ribs and six slots. Other arrangements are conceivable, such as an insert with three ribs and six slots.

FIG. 6 shows a longitudinal cut through the insert 1 along the line VI in FIG. 5. In this view the cut passes through two of the six slots 3, 3'. Openings 4, 4' allow for passage of liquid and/or air through the slots 3, 3'. Liquid entering the openings 4, 4' upon pouring may be set into a sinusoidal or rotating movement achieved by the sinuous-shaped slots 3, 3'. This flow pattern contributes to a better aeration of the liquid. The liquid will then be transported towards the proximal jacket end 2b through the annular space 8 between jacket 2 and pipe 5. Liquid travelling through the pipe 5 may here join the swirling liquid coming from the slots 3, 3', thereby adopting some of the turbulent flow regime of the latter.

Similarly, air entering the insert at the proximal jacket end 2*b* may travel through annular space 8 and slots 3, 3' into the bottle, where it replaces liquid that has been poured out. Air travelling this way may also be set into a sinusoidal or rotating movement, which may contribute to a better aeration of the liquid.

FIG. 7 shows a longitudinal cut through the insert 1 along the line VII of FIG. 5. This view exposes ribs 7, 7'. As seen in both FIGS. 6 and 7 the jacket 2 has the same longitudinal extent as the hollow pipe 5. As best seen in FIG. 7 the distal pipe end 5*a* is merged with the distal jacket end 2*a*.

In FIG. 8 there is shown one possible embodiment of a bottle pourer 9 comprising the pouring insert 1 of the present invention. The bottle pourer 9 also comprises a spout 10 for controlled and drip-minimized pouring of liquid into a receptacle such as a drinking glass (not shown). The spout 10 may be funnel-shaped, asymmetric and/or may comprise a chamfered end. The spout 10 is attached to the proximal jacket end 2*b*.

The rear view of FIG. 9 corresponds to a view presenting itself to a person looking down into a bottleneck into which the bottle pourer 9 is installed. The cavity 11 defined by the spout 11 allows for turbulent mixing and aeration of liquid passing through the slots 3, 3' and liquid passing through the pipe 5. The swirling, rotating movement of the liquid having passed through the slots may thus be advantageously transmitted to the liquid passing through the pipe 5. This may be better understood when inspecting the longitudinal section of FIG. 10, which is a cut along the line X of FIG. 9. The cavity 11 constitutes a mixing area where the fluxes from the slots 3, 3' and the flux of the pipe 5 combine. The spout 10 may be received in the jacket 2 in a core-sheath arrangement as seen in FIG. 10. To this end, the spout 10 may comprise a shoulder 12.

It should be noted that the figures illustrate the invention by way of example, and not limitation. Other shapes of the jacket are conceivable such as cylindrical, conical or similar. Any appropriate number of slots may be chosen, for example two, five, or ten slots. The slots need not necessarily be located concentrically around the pipe. Likewise, the arrangement of jacket and pipe is not necessarily centrical, but may be eccentric instead.

What is claimed is:

1. A pouring insert for insertion into a liquid container outlet, the pouring insert comprising:

a hollow jacket having a distal jacket end and a proximal jacket end, with the jacket tapering towards its distal jacket end, a hollow pipe axially disposed within the jacket and having a distal pipe end and a proximal pipe end, with the distal pipe end defining a first opening, the hollow jacket further comprising a plurality of elongated slots penetrating the jacket, the slots defining a plurality of second openings, wherein the least one of the elongated slots has a sinuous shape.

2. The pouring insert according to claim 1, wherein at least one of the elongated slots has a longitudinal alignment that is axial with respect to the jacket.

3. The pouring insert according to claim 1, wherein the jacket has a longitudinal extent that is the same as that of the hollow pipe.

4. The pouring insert according to claim 1, wherein the jacket has a longitudinal extent and the slots have longitudinal extents that are between 30 and 60% of the longitudinal extent of the jacket.

5. The pouring insert according to claim 1, wherein each of the elongated slots comprises first and second ends, with the first end being located closer to the distal jacket end than the second end, and with the first end being angularly displaced relative to the second end with respect to the cross section of the jacket.

6. The pouring insert according to claim 1, wherein the hollow pipe is disposed coaxially within the jacket, and the elongated slots are arranged concentrically around the hollow pipe.

7. The pouring insert according to claim 1, wherein the distal pipe end is merged with the distal jacket end.

8. The pouring insert according to claim 1, wherein the hollow pipe is fixed to the jacket by one or more ribs extending axially between the pipe and the jacket along at least part of the longitudinal extent of the pipe and the jacket.

9. The pouring insert according to claim 1, wherein the jacket is conically or frustoconically shaped.

10. The pouring insert according to claim 1, wherein one or more of the openings include means for filtering solid particles from a liquid.

11. A bottle pourer that includes a spout and the pouring insert according to claim 1.

12. The pouring insert according to claim 1 made of an injection molded plastic.

13. A method for aerating wine which comprises pouring wine through the pouring insert of claim 1.

14. The method according to claim 13, which further comprises providing the wine in a container having a liquid outlet; inserting the pouring insert into the liquid outlet, and tilting the container to effect outflow of liquid through the outlet and through the pouring insert.

15. The method according to claim 14, which further comprises providing the pouring insert with one or more openings through which the wine passes and providing one or more of the openings with means for filtering solid particles so as to remove such particles from the wine when pouring the wine from the container.

16. A method of manufacturing the pouring insert according to claim 1 by injection moulding the insert from food grade plastic material.

17. A pouring insert for insertion into a wine container outlet, the pouring insert comprising:

a hollow jacket having a distal jacket end and a proximal jacket end, with the jacket tapering towards its distal jacket end, a hollow pipe axially disposed within the jacket and having a distal pipe end and a proximal pipe end, with the distal pipe end defining a first opening, the hollow jacket further comprising a plurality of elongated slots penetrating the jacket, the slots defining a plurality of second openings, wherein the least one of the elongated slots has a sinuous shape and wherein at least one of the elongated slots has a longitudinal alignment that is axial with respect to the jacket, and wherein one or more of the secondary openings includes means for filtering solid particles so as to remove such particles from the wine when pouring the wine from the container through the insert.

* * * * *